US006216748B1

(12) United States Patent
Kutzleb et al.

(10) Patent No.: US 6,216,748 B1
(45) Date of Patent: Apr. 17, 2001

(54) PIVOTING MAGNET LATCHES FOR IMPROVED WEAVING DEVICE

(75) Inventors: Chester F. Kutzleb, Sagle; Roger King, Sandpoint; Anders Bostrom, Sandpoint; Robert Kellogg, Sandpoint, all of ID (US)

(73) Assignee: WIS Seaming Equipment, Inc., Sandpoint, ID (US)

( * ) Notice: Subject to any disclaimer, the term of this patent is extended or adjusted under 35 U.S.C. 154(b) by 0 days.

(21) Appl. No.: 09/458,756

(22) Filed: Dec. 10, 1999

(51) Int. Cl.[7] ..... D03C 13/00
(52) U.S. Cl. ..... 139/455; 139/59; 139/85
(58) Field of Search ..... 139/455, 59, 85

(56) References Cited

U.S. PATENT DOCUMENTS

| | | | | |
|---|---|---|---|---|
| 3,865,148 | * | 2/1975 | Wolfgang et al. | 139/59 |
| 3,918,500 | * | 11/1975 | Katsumata | 139/59 |
| 4,034,782 | * | 7/1977 | Bucher | 139/85 |
| 5,309,950 | * | 5/1994 | Bassi et al. | 139/88 |
| 5,628,347 | * | 5/1997 | Rush | 139/455 |
| 5,819,813 | * | 10/1998 | Dewispelaere | 139/455 |
| 5,839,481 | * | 11/1998 | Bassi et al. | 139/455 |
| 5,860,454 | * | 1/1999 | Mista et al. | 139/455 |
| 5,911,247 | * | 6/1999 | Waters | 139/455 |
| 6,041,831 | * | 3/2000 | Kuoni et al. | 139/55.1 |
| 6,050,302 | * | 4/2000 | Guse et al. | 139/1 R |
| 6,085,803 | * | 7/2000 | Dewispelaere | 139/455 |
| 6,105,628 | * | 8/2000 | Duhamel | 139/455 |

FOREIGN PATENT DOCUMENTS

| | | | | |
|---|---|---|---|---|
| 0292632 | * | 7/1987 | (EP) | D03C/3/44 |
| 0 421 370 A1 | | 4/1991 | (EP) . | |

OTHER PUBLICATIONS

Staubli AG brochure; "Name–Weaving Jacquard Machine CX 160"; undated; 6 pages.
Grosse Webereimaschinen GmbH brochure; "Electronic High Speed Jacquard–Machine EJP–3"; undated, 4 pages.

* cited by examiner

*Primary Examiner*—John J. Calvert
*Assistant Examiner*—Robert H. Muromoto, Jr.
(74) *Attorney, Agent, or Firm*—Wells, St. John, Roberts, Gregory & Matkin, P.S.

(57) ABSTRACT

A weaving device is described which includes a frame and an eyelet movably mounted thereto. A solenoid is also mounted to the frame and produces a magnetic field when energized. A latch is mounted on the frame for movement thereon to affect movement of the eyelet. A contact member is rotatably mounted to the latch and is magnetically attracted to the solenoid when energized.

64 Claims, 4 Drawing Sheets

PIVOTING MAGNET LATCHES FOR IMPROVED WEAVING DEVICE

TECHNICAL FIELD

The present invention relates to a weaving device and more specifically an improved latch for use with a Jacquard weaving device.

BACKGROUND OF THE INVENTION

Weaving devices, commonly called looms, are known in the art and have been in existence in one or another form for thousands of years. Weaving devices are generally used for producing woven fabric. Generally speaking, weaving devices consist of a frame, a generally horizontal array of eyelets movably supported by the frame between an upper position and a lower position, and a mechanism for moving the eyelets between the two positions.

To set up a typical weaving device for operation, a thread, or any type of weavable strand, is drawn off a spool and passed through an eyelet of the weaving device, then passed through a guide which is on the opposite side of the eyelet from the spool. The guide may be in the form of a long horizontal slot, or a gap between to horizontal, vertically opposed rollers. Each eyelet is threaded in this manner with an individual thread.

Selected eyelets are oriented the upper position and slightly above the guide, while the remaining eyelets are oriented in the lower position and slightly below the guide. This difference in the relative positions of the eyelets with respect to each other and to the guide, causes the threads to form an upper and lower row of parallel threads. The upper row passes from the upper eyelets to the guide, and the lower row passes from the lower eyelets to the guide. The two rows intersect, or meet, at the guide to form an acute interior corner. This formation of two rows of threads is generally called a shed. Thus, a shed can basically be described as two flat planes, each formed by a row of parallel threads, which meet to form a trough, or corner.

To begin the weaving process a cross-thread, called a weft thread, is placed into the corner of the shed where the threads meet at the guide, and perpendicular to the warp threads. After placement of the weft thread, the position of each eyelet is reversed—that is, the upper eyelets move to the lower position, and the lower eyelets move to the upper position. This change in position of the eyelets not only forms another shed, but also causes the warp threads to partially wrap around the weft thread. A second weft thread is then inserted into the corner of the new shed, and the position of each eyelet is again reversed. This process is continually repeated to form a fabric created from interlacing, or weaving, the warp and weft threads.

Basic woven fabric is produced on weaving devices which move the eyelets in a continuously repeating sequence of shed changes to produce a homogeneous fabric pattern. However, special type of weaving device, called a Jacquard device, may be used, among other purposes, to weave intricate or varying patterns into the fabric, or to perform seaming operations wherein two edges of fabric are woven together.

Jacquard devices are also well known in the art and have been in existence for hundreds of years. In a Jacquard device, each eyelet is individually selectively movable with each shed change. In other words, the sequence of movements of the eyelets is not merely repetitive, but may vary with each shed change.

Generally speaking, a Jacquard weaving device consists of an array of springs mounted on the top end of the frame of the weaving device. An eyelet is attached to each of the springs and hangs from the lower end of the spring. The springs bias the eyelets toward an upper position. A pulley block is attached to the lower side of each eyelet and hangs below the eyelet. A cord is strung through the pulley block, engaging the sheave, or pulley wheel, and both ends of the cord hang below the pulley block. The cord has two hooks attached to it, one on each end, which hang below the pulley block.

Attached to the frame, are two parallel horizontal bars, called griff bars, which reciprocally move up and down below the pulley block. The griff bars ire mechanically linked together so that, as one griff bar moves up, the other correspondingly moves down, and vice versa. An actuator is coupled to one of the griff bars to reciprocally move the griff bars at continuously repeating intervals.

The hooks are both engaged to guides mounted on the frame which restrict the path of movement of the hooks such that the path of movement of one of the hooks coincides with that of one of the griff bars, and the path of movement of the other hook coincides that of the other griff bar. Each hook has a slot or similar means which is open at the top, such that as the respective griff bar moves downward, it engages the slot, capturing the respective hook and pulling it downward. If the hook is held in its lowest position, the upward facing slot on the hook allows the griff bar to disengage the hook and move upward while leaving the hook in its lower position.

The cord which is connected between the hooks is of such a length that the respective spring, located above the eyelet, keeps the cord taught at all times. When both hooks are engaged to each respective griff bar, the hooks and cord travel in a reciprocal see-saw motion along with the griff bars, with the cord being pulled back and forth through the pulley block and rolling over the sheave. During this see-saw motion, the pulley block and eyelet remain stationary in the upper position, being held up by the tension of the respective spring.

The lower end of each hook is engageable with a pair of latches which are mounted on the frame and are located near the bottom of the path of travel of the respective hook. Each latch selectively captures and retains the respective hook in the lower position. As previously mentioned, if one of the hooks is held in its lower position by the respective latch, the respective griff bar disengages the hook as it travels upward, leaving the hook retained by the latch in the lower position. As the first griff bar moves upward, leaving one of the hooks retained by the first latch, the second hook is simultaneously pulled downward toward the second latch by the second griff bar as the first griff bar travels upward. Because the first hook is latched in the lower position, and is not allowed to raise up as the second hook is being pulled downward, the pulley block is pulled downward by the cord attached between the hooks, which pulls the eyelet downward against the force of the respective spring. This results in the eyelet reaching a lower position as both hooks are in their respective lower positions.

For the eyelet to remain in the lower position, both the first and second hooks must be retained in their respective lower positions by their respective latches. In this manner, the griff bars continue to reciprocally move in a see-saw motion above both hooks, but do not cause movement of the hooks, cord, pulley block, or eyelet.

Conversely, for the eyelet to raise to its upper position once again, one of the latches must disengage its respective hook as the respective griff bar is in the lower position and engaged to the respective latch. In this manner, one of the hooks is released by the latch and allowed to raise up with the griff bar to its upper position under the tension of the spring. This results in the respective pulley block and eyelet moving upward to their respective upper positions. For the eyelet to remain in the upper position, the other latch must also release its respective hook, allowing the see-saw motion of the hooks and cord to resume as initially described.

Many Jacquard weaving devices utilize electric solenoids to cause the selective retention of the hooks by the latches. In this type of design, an electric solenoid is mounted on the frame near each respective latch. Mounted on each latch is a material, such as iron, which is attracted by the magnetic field produced by the solenoid when the solenoid is energized with electrical current. Generally, each latch is biased in a latched position. As a hook is moved into engagement with the respective latch, the hook pushes the latch into its unlatched position and toward the solenoid such that the magnetically attractable material is pressed against the solenoid. If the solenoid is energized, the material is held against the solenoid by the magnetic field, holding the latch in the unlatched position, which prevents the latch from retaining the hook in the lower position.

Conversely, if the solenoid is not energized, the bias of the latch causes the latch to move back to the latched position as the hook begins to move upward and disengage the latch. However, before the hook completely disengages the latch, the latch captures the hook, retaining it in the lower position. If the hook is retained by the latch, the subsequent downward stroke of the respective griff bar will again move the hook against the latch in a manner which will cause movement of the latch to the unlatched position. This enables the hook to be released from the latch if the latch is held in the unlatched position by the solenoid. In this manner, the weaving device selectively moves the eyelet by energizing and de-energizing the solenoids at given intervals which controls the movement of the hooks. Often a controller, such as a programmable logic computer, it utilized to selectively control electrical current flow to the solenoids, as well as the motion of the griff bars.

Commonly, a Jacquard weaving device consists of at least one row of eyelets which are configured as discussed above, with respective springs, pulley blocks, cords, hooks, latches and solenoids for each eyelet. Usually, the entire row of eyelets is served by a single pair of elongated griff bars. In this manner, each individual eyelet in the row may be moved from either the upper position to the lower position, or vice versa, or may remain in either the upper or lower position, with each reciprocal stroke of the griff bars. Often, large Jacquard weaving devices consist of several such rows of similarly configured eyelets, each with its own set of griff bars. Thus, by moving the griff bars at repeating intervals, and selectively controlling the energization of the solenoids, the controller can cause any combination of eyelets to either move up or down, or remain in the upper or lower positions, with each shed change.

While Jacquard weaving machines of conventional design have been operated with varying degrees of success, there have been associated shortcomings which have detracted from their usefulness. For example, a relatively large Jacquard weaving machine may consist of a dozen or more rows of eyelets, each row having up to thirty or more eyelets. Such a machine, having upwards of three hundred individually movable eyelets, will have a complex, tightly packed mechanism comprised of interactive, precision components, including griff bars and related drive trains, hooks, latches, solenoids, cords, guides, and pulley blocks. Thus, a malfunction or failure of a component in the center of this tightly packed mechanism necessitates a tedious and time-consuming disassembly task in order to simply gain access to the failed or malfunctioning part for removal and replacement. This tedious disassembly process of the machine results in costly down-time of the weaving device, during which the operation of the device is temporarily halted. Further, the solenoids sometimes fail to retain the respective latches due to misalignment of the latch a nd solenoid, causing a mis-weave.

Therefore, it has long been known that it would be desirable to provide a Jacquard weaving machine which achieves the benefits to be derived from similar prior art devices, but which avoids the detriments individually associated therefrom.

SUMMARY AND OBJECTIVES

In accordance with one aspect of the present invention, a weaving device comprises a frame, an eyelet movably mounted on the frame, and a solenoid mounted on the frame, which produces a magnetic field when energized with electrical current. A latch is rotatably mounted on the frame, and movement of the latch effects the movement of the eyelet. A contact member is rotatably mounted on the latch. The contact member is magnetically attracted to the solenoid when the solenoid is energized.

Another aspect of the present invention relates to a weaving device having a frame, an eyelet movably mounted on the frame, and a hook mounted on the eyelet. The weaving device further includes a solenoid borne by the frame and which, when energized, produces a magnetic field. A latch is provided having a first axis of rotation. A contact member is rotatably mounted on the latch about a second axis of rotation, and is magnetically attracted to the solenoid when energized.

Yet another aspect of the present invention relates to a weaving device comprising a frame, an eyelet movably mounted on the frame, a hook mounted on the eyelet and movable along a course of travel, and a solenoid mounted on the frame. The solenoid produces a magnetic field when energized with electrical current. A latch is rotatably mounted on the frame, and which is movable between a latched position and an unlatched position. A contact member is rotatably mounted on the latch. The contact member is fabricated from a material which is magnetically attracted to the solenoid when the solenoid is energized. Movement of the hook into contact with the latch causes the latch to move to the unlatched position. Such movement of the latch to the unlatched position forces the contact member against the solenoid. The contact member rotatably aligns with the solenoid upon contact to facilitate magnetic attachment of the contact member to the solenoid when the solenoid is energized.

A still further aspect of the present invention relates to a weaving device comprising a frame, an eyelet movably mounted on the frame, a hook mounted on the eyelet and reciprocally movable along a course of travel, and a solenoid mounted on the frame. The solenoid has a solenoid face, and produces a magnetic field when energized with electrical current. A latch is pivotally mounted on the frame and is movable with respect to the frame about a first axis between a latched position and an unlatched position. The latch is biased toward the latched position. The latch has a first resilient member made integral therewith and a contact member rotatably mounted on the latch. The contact member is fabricated from a material which is magnetically attracted to the solenoid when it is energized. The contact member is rotatable with respect to the latch about a second axis. The second axis is substantially parallel to the first axis. Movement of the hook into contact with the first resilient member, as the hook moves along the path of travel, urges the latch to the unlatched position and simultaneously causes the contact member to be forced against the solenoid face. Upon contact with the solenoid face, the contact member rotatably aligns with the solenoid face to facilitate the magnetic attachment thereto.

A yet further aspect of the present invention relates to a weaving device comprising a frame, an eyelet movably mounted on the frame, a hook mounted on the eyelet and reciprocally movable along a course of travel in a first direction and an opposite second direction, and a solenoid mounted on the frame and which has a solenoid face. The solenoid produces a magnetic field when energized with the electrical current.

A latch is pivotally mounted on the frame. The latch is rotatable with respect to the frame about a first axis, between a latched position and an unlatched position. The first axis is substantially parallel to the solenoid face.

The latch further includes a first resilient member and a contact member rotatably mounted on the latch. The contact member is fabricated of a material which is magnetically attracted to the solenoid when energized. The contact member is rotatable with respect to the latch about a second axis which is substantially parallel to the first axis.

The contact member has a contact surface formed thereon. The hook, upon movement in the first direction, engages the first resilient member. Such movement of the hook against the first resilient member moves the latch to the unlatched position and simultaneously moves the contact surface against the solenoid face causing the contact member to rotatably align with the solenoid. Continued movement of the hook in the first direction and against the first biasing member, when the latch is in the unlatched position, causes a further deflection of the first biasing member which ensures substantially parallel alignment of the contact surface with the solenoid face, and facilitates magnetic attachment of the contact member to the solenoid when the solenoid is energized.

A still further aspect of the invention relates to a weaving device comprising a frame, an eyelet movably mounted on the frame, and a hook having a first end and an opposite second end. The second end is mounted on the eyelet. The hook is reciprocally movable along a course of travel in a first direction and an opposite second direction. A solenoid is mounted on the frame to produce a magnetic field when energized with electrical current.

A latch is pivotally mounted on the frame, and which has a main body with a first end, and an opposite second end. The latch is pivotable with respect to the frame about a first axis between a latched position and an unlatched position. The first end of the latch is matingly engageable with the hook. The latch is biased toward the latched position. The first end of the latch has a first resilient member made integral therewith.

The first biasing member is located between the first end and the first axis. A contact member is rotatably mounted on the latch. The contact member is made of a material which is magnetically attracted to the solenoid when it is energized. The contact member is rotatable with respect to the latch about a second axis. The second axis is substantially parallel to, and offset from, the first axis. Movement of the first end of the hook against the first resilient member as the hook moves in the first direction causes movement of the latch to the unlatched position.

In the unlatched position, the contact member is moved against the solenoid face which causes the contact member to rotatably align with the solenoid face. Continued movement of the hook in the first direction and against the first resilient member causes the hook to deflect the first resilient member. Such deflection causes the contact member to be forced against the solenoid face to ensure substantially complete contact of the contact member with the solenoid face to facilitate magnetic attachment of the contact member to the solenoid face when energized. The presence of the magnetic field when the latch is in the unlatched position causes the latch to be retained in the unlatched position such that the hook is prevented from engaging the latch as the hook moves in the second direction.

A still further aspect of the present invention relates to a weaving device having a frame, an eyelet movably mounted on the frame, and a hook which is mounted on the eyelet and movable along a course of travel. The weaving device includes a solenoid borne by the frame and operates to create a magnetic field when selectively energized. A latch is pivotally borne by the frame and operates to selectively engage the hook. The latch has an elongated main body with opposite first and second ends. The elongated main body is oriented along a line of reference which extends between the first and second ends. The main body is rotatable about a first axis which is located intermediate the first and second ends and is laterally offset from the line of reference.

The main body is rotatable between a latched and unlatched position. The first end of the latch is shaped to matingly engage the hook when the main body is in the latched position. A first resilient member is borne by the main body and is located between the first end and the first axis. The first resilient member is oriented in a position which is oblique to, and laterally offset from the line of reference. The first resilient member urges the latch into the unlatched position when it is engaged by the hook.

A self-aligning contact member is rotatably borne on the second end of the main body. The contact member is fabricated from a material which is magnetically attracted to the solenoid when it is energized. The contact member rotates about a second axis which is oriented along the line of reference. The main body, when located in the unlatched position, causes the contact member to be moved into substantially immediate self-aligned contact with the solenoid and the energized solenoid retains the latch in the unlatched position.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
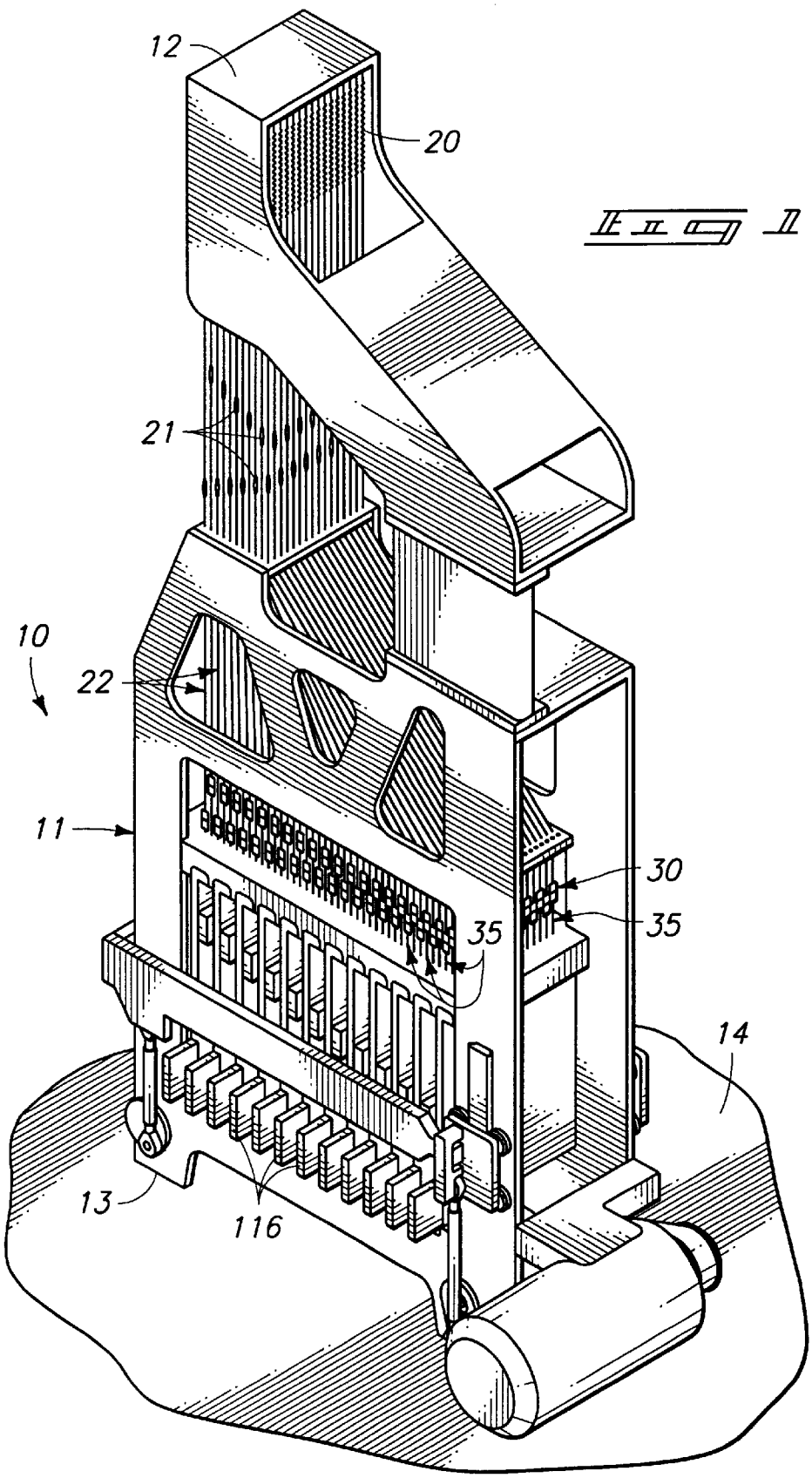
FIG. 1 is a perspective view generally illustrating a preferred weaving device incorporating preferred features of the present invention.
Figure 2:
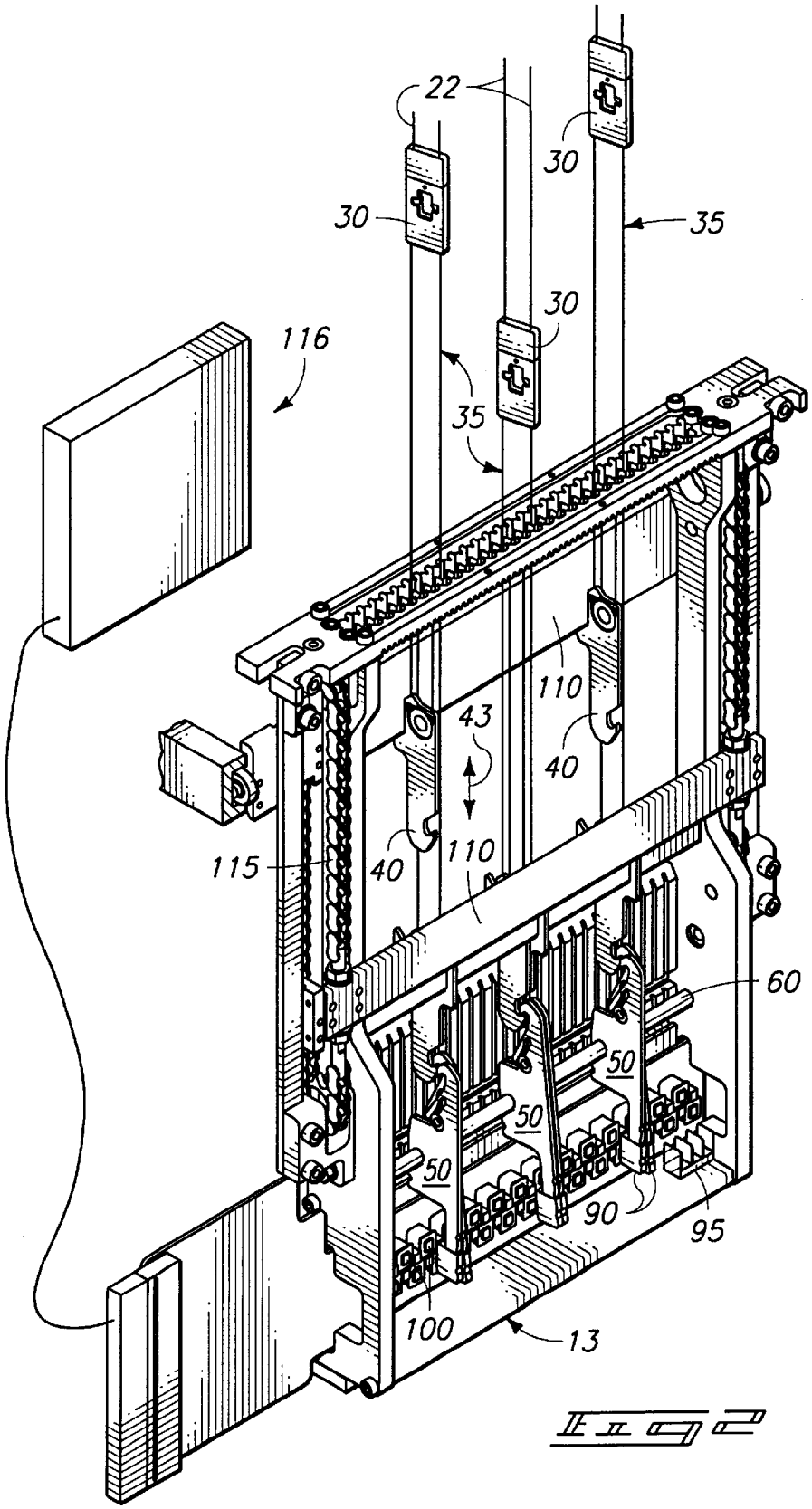
FIG. 2 is a perspective view of a single frame module of the present weaving device.

The apparatus of the subject invention is best understood by a study of FIG. 1 and is generally indicated by the numeral 10. The apparatus 10 has a frame 11 which has an upper first end generally indicated by the numeral 12, and a lower second end generally indicated by the numeral 13. The frame 11 rests on the surface of the earth 14. The apparatus 10 includes a plurality of biasing members 20 which are each individually mounted to the first end 12 of the frame 11. Mounted on each biasing member 20 is an eyelet 21. The resilient nature of the biasing members 20 allows the eyelets 21 to be movably mounted on the frame 11.

First cords 22 are individually affixed, one to each eyelet 21 and are further operably engaged with pulley blocks 30. Second cords 35 are connected to the frame 11 and are also operably engaged to the pulley blocks 30. Hooks 40 (FIGS. 3–5) each have a first end 41 and a second end 42 and operably engage a second cord 35. The second ends 42 of the hooks 40 are thus effectively mounted to the eyelets and move therewith. The hooks 40 are each reciprocally movable along a course of travel 43 in a first direction 44 and an opposite second direction 45.

On the second end 13 of the frame 11 are a plurality of latches 50 (FIGS. 3–7) which are pivotably borne by module portions of the frame 11 and which are operable to selectively engage the hooks 40.

Each latch 50 has an elongated main body 51 with opposite first and second ends 52 and 53 respectively. The elongated main body 51 is oriented along a line of reference 54 which extends between the first and second ends 52 and 53. Also, the main body 51 of the latch 50 is rotatable about a first axis 55 which is located intermediate of the first and second ends 52 and 53, and which is laterally offset from the line of reference 54. A substantially cylindrically shaped shaft 60 is substantially coaxially aligned relative to the first axis of rotation 55 of the latch 50. The latch 50 defines a substantially circular aperture 61 which rotatably receives the shaft 60, and thus, the latch 50 is rotatably mounted on the shaft 60.

Figure 3:
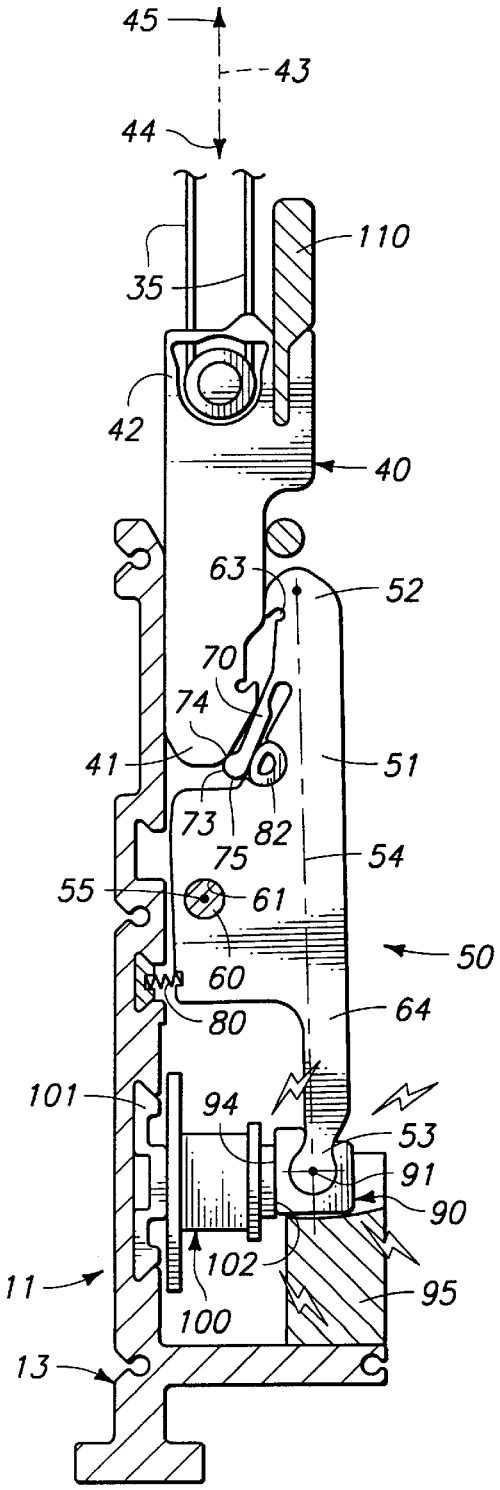
FIG. 3 is an enlarged detail view of a preferred latch and hook arrangement with the latch being forced by the hook to an unlatched position.
Figure 4:
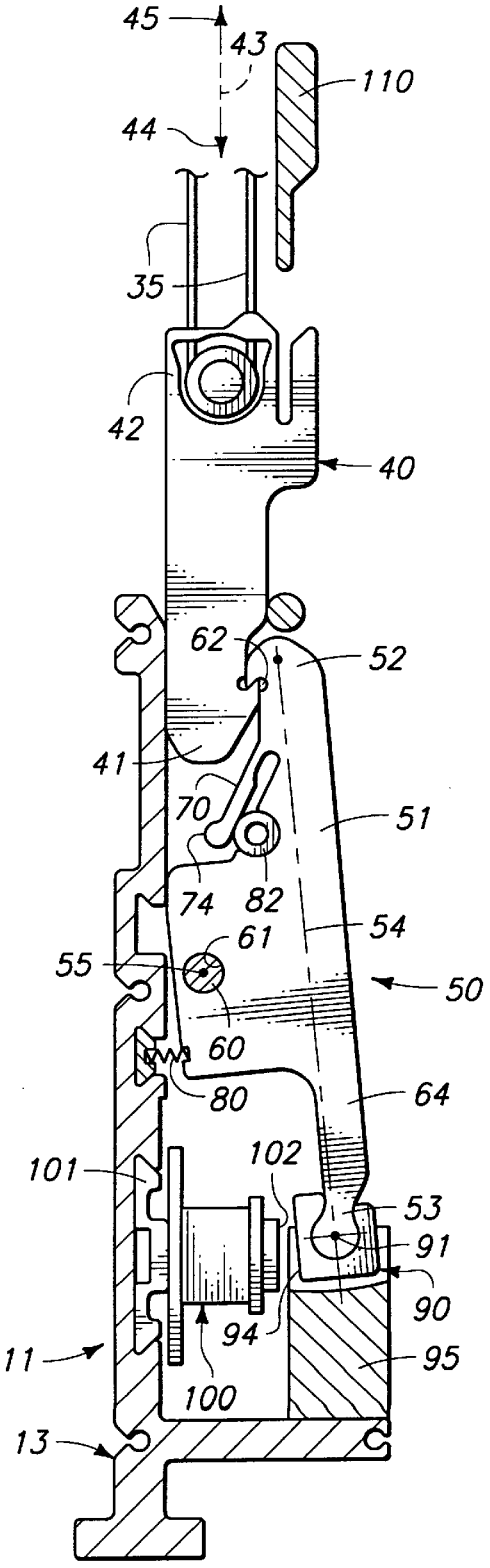
FIG. 4 is a view similar to FIG. 3 only showing the latch in a latched position.
Figure 5:
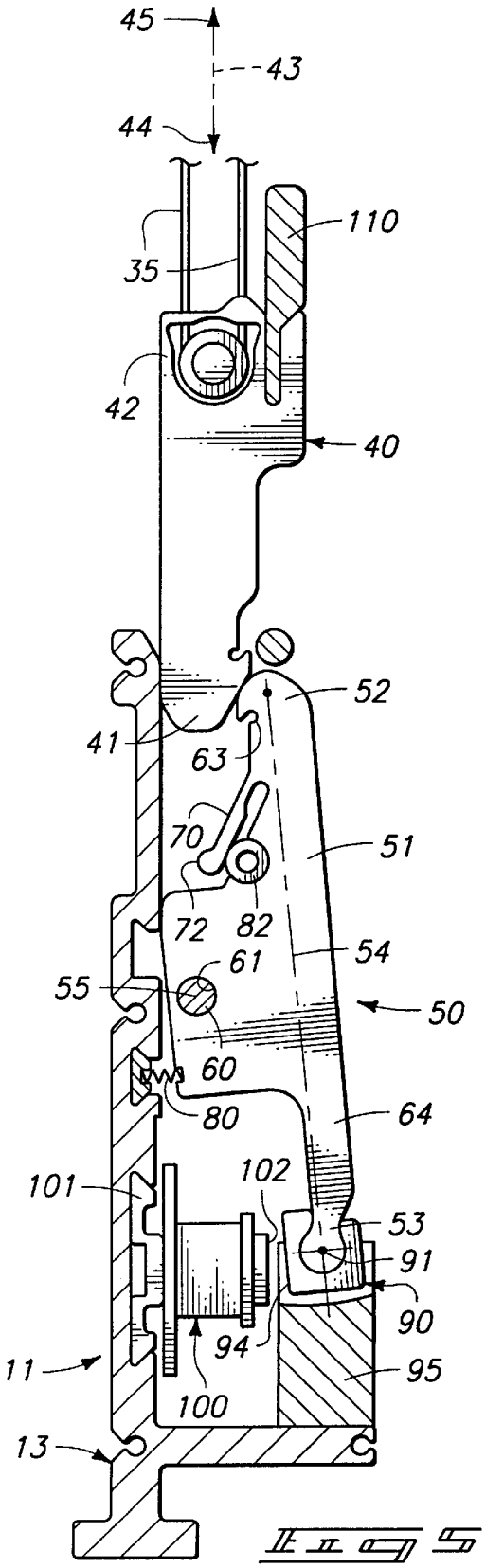
FIG. 5 is a view similar to FIG. 3 only showing the latch secured by magnetism in the unlatched position.
Figure 6:
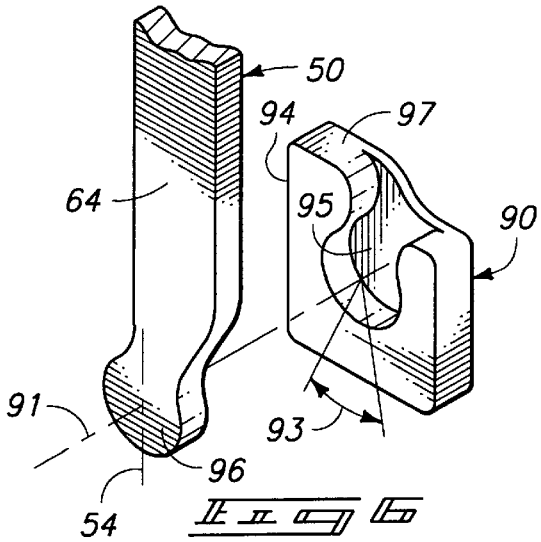
FIG. 6 is an enlarged perspective exploded detail view of a second end of the latch and an associated contact member.

The main body 51 of each latch 50 is rotatable about the shaft 60 between a latched position 62 (FIG. 4) and an unlatched position 63 (FIG. 3). The first end 52 of the latch 50 is shaped to matingly engage the hook 40 when the main body 51 is in the latched position 62 (FIG. 4).

The latches 50 are substantially planar plates each having a substantially constant thickness, and wherein the first axis 55 is preferably substantially normal to the plate.

The weaving device apparatus 10 further includes first resilient members 70 which are made integral with the individual latches 50. The first resilient members 70 are borne by the main body 51 and located between the first end 52 and the first axis 55. Each of the first resilient members 70 extends generally obliquely in the direction of the second end 53 of the latch 50 and is oriented in a position which is oblique to, and laterally offset from, the line of reference 54, and is oblique to the first and second directions of travel 44, 45.

Figure 7:
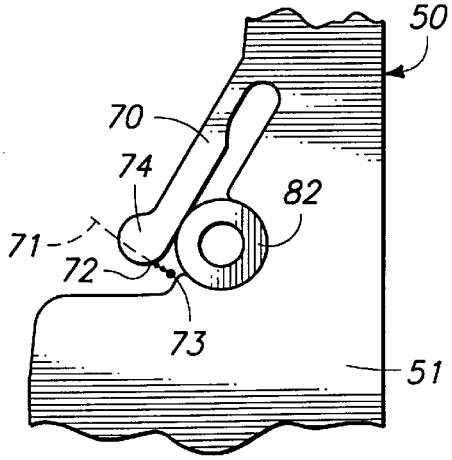
FIG. 7 is an enlarged fragmented side elevation detail view of a first and third resilient member.

Referring to FIG. 7, the exemplified first resilient member 70 is an elongated deflectable member which deflects along an arcuately shaped path of travel 71. The path of travel 71 is between a first point of travel 72 and a second point of travel 73. The first resilient member 70 is operable to deflect along the given path of travel 71 in response to engagement with the hook 40.

The first resilient members 70 each include a raised button 74 at an end 75 thereof. Each button 74 is intended for engagement with a corresponding hook end 41 moving toward the second frame end 13 and for localizing the force transmitted by the hook at the end of the associated resilient member 70, thereby allowing the member 70 to bend resiliently along its length. The resilient member 70 thus translates linear motion of the engaged hook 40 to yieldable pivotal motion of the latch 50 about the first axis 55.

The weaving device apparatus 10 further comprises second resilient members 80 which are mounted on the frame 11 and which are disposed in forced transmitting relation between the frame 11 and the latches 50. In each latch, the second resilient member 80 coacts with the latch 50 at a location between the first axis of rotation 55 and the second latch end 53 to bias the latch 50 toward the latched position 62.

Each latch 50 further includes a third resilient member 82 located between the first axis of rotation 55 and the first end 52 and which further coacts with the first resilient member 70 to limit motion of the first resilient member 70. Also, the third biasing member 82 comprises a releasable member mounted on the latch 50.

Each of the latches further includes a resilient leg segment 64 that is intended to deflect slightly when the latch is in the latched position 62. The legs lend even more resiliency along the length of the latches.

The weaving device apparatus 10 also includes a self-aligning contact member 90 rotatably borne on the second end 53 of each latch main body 51 and which rotates about a second axis of rotation 91 (FIG. 6) which is oriented along the line of reference 54 and is located adjacent to the second end 53 of the latch 50. The second axis of rotation 91 is preferably substantially parallel to the first axis of rotation 55 and normal to the latch plate. The second axis of rotation 91 is also laterally offset from the first axis of rotation 55 with respect to the line of reference 54. The rotation of the contact member 90 about the second axis of rotation 91 is restrained to a predetermined range of rotation (represented by the numeral 93) by the latch 50. The contact member 90 also has a contact surface 94 formed thereon.

Each contact member 90 is cupped (FIG. 6), having a recess 95 that is shaped to pivotably receive a complementary semi-circular end configuration 96 of the associated latch 50. The side 97 of the contact member opposite the cupped side is flat and planar so that two of the contact members may be placed back-to-back in close proximity with one another. This allows a pair of latches 50 to be used for each solenoid 100, with each latch of the pair being independently movable between the latched and unlatched positions. Further, a castellated guide member 98 is mounted to the frame with spaced slots that slidably receive and guide the paired contact members through their pivotal movement.

The weaving device apparatus also comprises a plurality of solenoids 100 operable to produce individual magnetic fields when selectively energized with electrical current.

Each solenoid 100 is mounted on a support member 101 and is releasably borne by the frame 11 to facilitate removal and replacement thereof. Furthermore, the solenoid 100 has a solenoid face 102 which lies in a plane that is preferably substantially parallel to the first axis of rotation 55. The solenoid 100 is mounted on the frame 11 so as to operably coact with the contact member 90 once the latch 50 is moved from the latched position 62 to the unlatched position 63.

The weaving device apparatus 10 further comprises a griff bar 110 which is movably mounted on the frame 11 and which selectively engages hooks 40 and provides movement thereto. Further included in the apparatus 10 is a actuator 115 which is coupled in transmitting relation relative to the griff bar 110, and which provides selective movement to the griff bar 110. A controller 116 is electrically coupled to the solenoid 100 and to the actuator 115. The controller 116 selectively provides electrical current to both the solenoid 100 and the actuator 115.

Operation

The operation of the described embodiment of the present invention is believed to be readily apparent and is briefly summarized at this point.

As earlier discussed, the weaving device apparatus 10 of the subject invention comprises a frame 11 resting on the surface of the earth 12. Mounted on the frame 11, is an eyelet 21 which is movable with respect to the frame 11. The movement of the eyelet 21 originates with a motive force which is generated by an actuator 115 and which is coupled in transmitting relation to a griff bar 110. The griff bar 110 is also movably mounted on the frame 11 and selectively engages a hook 40 to provide movement thereto.

The hook 40 has a first end 41 and an opposite second end 42. The second end 42 of the hook 40 is connected to the eyelet 21 through a second cord 35, a pulley block 30 and a first cord 22. The hook 40 is selectively moved by the griff bar 110 along a reciprocal course of travel 43 in a first direction 44 and an opposite second direction 45.

The movement of the hook 40 is influenced in the second direction 45 by a latch 50 which is movably mounted near the second end 13 of the frame 11. The latch 50 rotates about a first axis 55 along, an arcuate path of travel 56 between a latched position 62 and an unlatched position 63. The latch 50 has a main body 51 as well as a first end 52 and an opposite second end 53. The first end 52 of the main body 51 matingly engages the hook 40 as the hook moves to its second position. The second resilient member 80 is borne by the frame 11 and coacts with the main body 51 to urge the latch 50 in the direction of the latched position 62. The latch 50 is normally biased toward the latched position 62 by the second resilient member.

As the hook 40 is moved by the griff bar 110 in the first direction 44 along the course of travel 43, the hook comes into contact with the first end 52 of the latch 50 against the button 74 and the first and third resilient members 70, 82 to urge the latch 50 to move against yieldable resistance from the second resilient member into the unlatched position 63. Thus, the hook 40 is operable to effect movement of the latch 50 between the latched position 62 and the unlatched position 63, wherein movement of the hook 40 into contact with the latch 50 causes the latch 50 to move to the unlatched position 63. The latch 50 includes the contact member 90 which is rotatably mounted on the second end 53 of the latch 50 about the second axis of rotation 91. The pivoting second end of the latch moves toward the solenoid 100, bringing the contact member 90 into flush engagement with the solenoid surface 102. The contact surfaces 94 will freely pivot into flush engagement with the solenoid surface 102.

The weaving apparatus 10 further includes the solenoid 100 which is releasably mounted on the frame 11 near the second end 13 thereof, so as to coact with the latch 50 as the latch 50 rotates between the latched position 62 and the unlatched position 63. The solenoid 100 produces a magnetic field when it is energized with electrical current. Contact member 90 is fabricated from a material which is magnetically attracted to the solenoid 100 when the solenoid 100 is energized with electrical current.

Movement of the hook 40 into contact with the latch 50 moves the contact member 90 against the solenoid 100 to facilitate magnetic attachment of the contact member 90 to the solenoid 100 when the solenoid 100 is energized. Thus, when the latch 50 is in the unlatched position 63 the contact member 90 is disposed in contact with the solenoid 100, and remains in this position when the solenoid 100 is energized. Stated another way, when the latch 50 is in the unlatched position 63, the solenoid 100 may be magnetically actuated to coact with the contact member 90 and retain the latch 50 against the bias of the second resilient member 80 in the unlatched position 63.

The rotatable nature of the contact member 90 about the second axis 91 causes the contact member 90 to be moved into substantially immediate self-aligned contact with the solenoid 100 when the main body 51 of the latch 50 is located in the unlatched position 63 and wherein the solenoid 100 retains the latch 50 in the unlatched position 63 when energized.

The main body 51 of the latch 50 further includes a first resilient member 70 which is operable to deflect along a given path of travel 71 between a first point of travel 72 and a second point of travel 73, and which coacts with the hook 40. As the hook 40 comes into contact with the latch 50, the first resilient member 70 transmits force from the hook 40 to the latch 50 to simultaneously move the latch 50 toward the unlatched position 63, and to move the contact member 90 into contact with the solenoid 100.

Thus, the hook 40 moves in force transmitting relation against the first resilient member 70 and deflects the first resilient member 70 to cause the latch 50 to move in the first direction to the unlatched position 63, and further ensures contact and proper alignment of the contact member 90 against the solenoid face 102 of the solenoid 100. The resilient leg section 64 may also deflect at this point.

Stated yet another way, the movement of the hook 40 into force engaging contact with first resilient member 70, as the hook 40 moves along the course of travel 43, urges the latch 50 to the unlatched position 63 and simultaneously causes the contact member 40 to be forced against the solenoid face 102, and wherein, upon contact with the solenoid face 102, the contact member 90 rotatably aligns with the solenoid face 102 to facilitate the magnetic attachment thereto.

The latch 50 further includes a third resilient member 82 which is mounted on the main body 51 of the latch 50 and which coacts with the first resilient member 70 to resist deflection of the first resilient member 70 beyond the second point of travel 73. Thus movement of the hook 40 into contact with the first end 52 of the latch 50 causes the first resilient member 70, the second resilient member 80 and the third resilient member 82 to be compressed. The solenoid 100, when de-energized, does not retain the contact member 90. The movement of the hook 40 away from the latch 50 allows the second resilient member 80 to urge the latch 50 from the unlatched position 63 back to the latched position 62.

However, the first end 52 of the latch 50 is shaped to engagingly mate with the hook 40 and retain the hook 40 when the latch 50 is moved to the unlatched position 62. When the latch 50 matingly engages the hook 40 and retains same, the upwardly moving griff bar 110 disengages from the hook 40 leaving the hook 40 engaged with the latch 50. Thus, the hook 40 coacts with the latch 50 to effect movement of the eyelet 21.

Therefore, movement of the first end 41 of the hook 40 against the first resilient member 70 as the hook 40 moves in the first direction 44 causes movement of the latch 50 to the unlatched position 63. As the latch 50 is moved into the unlatched position 63 the contact member 90 is moved against the solenoid face 102 which causes the contact member 90 to rotatably align with the solenoid face 102. Continued movement of the hook 40 in the first direction 44 and against the first resilient member 70 causes the hook 40 to deflect the first resilient member 70, which causes the contact member 90 to be forced against the solenoid face 102 to ensure substantially complete contact of the contact member 90 with the solenoid face 102.

This substantially complete contact of the contact member 90 with the solenoid face 102 facilitates magnetic attachment of the contact member 90 to the solenoid face 102 when the solenoid 100 is energized. When the solenoid 100 is energized and produces a magnetic field, the presence of the magnetic field, when the latch 50 is in the unlatched position 63, causes the latch 50 to be retained in the unlatched position 63 such that the hook 40 is prevented from engaging the latch 50 and being retained by the latch 50 as the hook 40 moves away from the latch in the second direction 45.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A weaving device comprising:

a frame;

an eyelet movably mounted on the frame;

a solenoid mounted on the frame, and which produces a magnetic field when energized with electrical current;

a latch rotatably mounted on the frame, and wherein the movement of the latch affects the movement of the eyelet; and a contact member rotatably mounted on the latch, and which is magnetically attracted to the solenoid when the solenoid is energized.

2. A weaving device as claimed in claim 1, and further comprising a hook mounted on the eyelet and movable therewith into contact with the latch, and wherein the hook coacts with the latch to affect the movement of the eyelet.

3. A weaving device as claimed in claim 2, and wherein the latch is movable between a latched and an unlatched position.

4. A weaving device as claimed in claim 3, and wherein movement of the hook into contact with the latch moves the contact member against the solenoid to facilitate magnetic attachment of the contact member to the solenoid when the solenoid is energized.

5. A weaving device as claimed in claim 4, and further comprising a griff bar movably mounted on the frame and which selectively engages the hook and provides movement thereto.

6. A weaving device as claimed in claim 5, and further comprising an actuator coupled in force transmitting relation relative to the griff bar and which provides selective movement thereto.

7. A weaving device as claimed in claim 6, and further comprising a controller electrically coupled to the solenoid and the actuator and which selectively provides electrical current thereto.

8. A weaving device as claimed in claim 7, and wherein the latch has a main body having a first end which selectively engages the hook, and an opposite second end, and wherein the contact member is rotatably mounted on the second end.

9. A weaving device as claimed in claim 8, and wherein the first end of latch is shaped to engagingly mate with the hook when the latch is moved to the latched position, and wherein the main body further includes a first resilient member which is operable to deflect along a given path of travel and coact with the hook, the first resilient member transmitting force from the hook to simultaneously move the latch toward the unlatched position, and the contact member into contact with the solenoid.

10. A weaving device as claimed in claim 9, and wherein the main body of the latch is pivotally mounted on the frame, and wherein a second resilient member is borne by the frame and coacts with the main body when the latch is in the unlatched position to urge it in the direction of the latched position.

11. A weaving device as claimed in claim 10, and wherein the latch further includes a third resilient member which is borne by the main body thereof, and which resiliently coacts with the first resilient member to limit the movement of same.

12. A weaving device as claimed in claim 11, and wherein the main body of the latch rotates along an arcuately shaped path of travel, and wherein the hook, upon contacting the first end of the latch, exerts force on same to urge the latch into the unlatched position, and wherein in the unlatched position the contact member is disposed in contact with the solenoid and remains in this position when the solenoid is energized, and wherein movement of the hook into contact with the first end of the latch further causes the first and second resilient members to be compressed, and wherein the solenoid, when de-energized, does not retain the contact member, and movement of the hook away from the latch causes the second resilient member to urge the latch from the unlatched position to the latched position, and wherein the first end of the main body matingly engages the hook.

13. A weaving device having a frame, an eyelet movably mounted on frame, and a hook mounted on the eyelet, the weaving device comprising:

a solenoid borne by the frame and which, when energized, produces a magnetic field;

a latch having a first axis of rotation; and a contact member rotatably mounted on the latch about a second axis of rotation, and magnetically attracted to the solenoid when energized.

14. A weaving device as claimed in claim 13, and wherein the latch rotates between a latched and an unlatched position, and wherein, when the latch is in the unlatched position, the solenoid is selectively operable to magnetically coact with the contact member to retain the latch in the unlatched position.

15. A weaving device as claimed in claim 14, and wherein the hook is operable to effect the movement of the latch between the latched position and the unlatched position.

16. A weaving device as claimed in claim 15, and further comprising a second resilient member disposed between the frame and the latch, and which biases the latch toward the latched position.

17. A weaving device comprising:

a frame;

an eyelet movably mounted on the frame;

a hook connected to the eyelet and movable along a course of travel;

a solenoid mounted on the frame, and wherein the solenoid produces a magnetic field when energized with electrical current;

a latch rotatably mounted on the frame, and which is movable between a latched position and an unlatched position; and a contact member rotatably mounted on the latch, and which is fabricated from a material which is magnetically attracted to the solenoid when the solenoid is energized, and wherein movement of the hook into contact with the latch causes the latch to move to the unlatched position, and wherein such movement of the latch to the unlatched position forces the contact member against the solenoid, and wherein the contact member rotatably aligns with the solenoid upon contact therewith to facilitate the magnetic attachment of the contact member to the solenoid when the solenoid is energized.

18. A weaving device as claimed in claim 17, and wherein the latch further has a first resilient member made integral therewith.

19. A weaving device as claimed in claim 18, and wherein the latch is rotatable about a first axis, and the contact member is rotatable about a second axis, and wherein the first and second axes are substantially parallel, and offset one from another.

20. A weaving device as claimed in claim 19, and wherein the solenoid has a solenoid face, and wherein the hook moves against the first resilient member and deflects the first resilient member to cause the latch to move to the unlatched position, and further ensures contact and proper alignment of the contact member against the solenoid face.

21. A weaving device as claimed in claim 20, and further comprising a griff bar movably mounted on the frame, and which selectively engages the hook and provides movement thereto.

22. A weaving device as claimed in claim 21, and further comprising an actuator coupled in force transmitting relation relative to the griff bar.

23. A weaving device as claimed in claim 22, and further comprising a controller electrically coupled to the solenoid and actuator, and selectively providing electrical current thereto.

24. A weaving device as claimed in claim 23, and wherein the main body of the latch is pivotally mounted on the frame, and wherein a second resilient member is borne by the frame and coacts with the main body when the latch is in the unlatched position to urge it in the direction of the latched position.

25. A weaving device as claimed in claim 24, and wherein the latch further includes a third resilient member which is borne by the main body thereof, and which resiliently coacts with the first resilient member to limit the movement of same.

26. A weaving device as claimed in claim 25, and wherein the latch has a main body with a first end which selectively engages the hook, and a second end which rotatably mounts the contact member, and wherein the first resilient member is mounted intermediate the first and second ends of the main body.

27. A weaving device comprising:

a frame;

an eyelet movably mounted on the frame;

a hook mounted on the eyelet and reciprocally movable along a course of travel;

a solenoid mounted on the frame, and which has a solenoid face, and wherein the solenoid produces a magnetic field when energized with electrical current;

a latch pivotally mounted on the frame, and which is movable with respect to the frame about a first axis between a latched position and an unlatched position, and wherein the latch is biased in the direction of the latched position, and wherein the latch has a first resilient member made integral therewith; and a contact member rotatably mounted on the latch, and wherein the contact member is fabricated from a material which is magnetically attracted to the solenoid when it is energized, and wherein the contact member is rotatable with respect to the latch about a second axis, and wherein the second axis is substantially parallel to the first axis, and wherein movement of the hook into force engaging contact with the first resilient member, as the hook moves along the path of travel, urges the latch to the unlatched position and simultaneously causes the contact member to be forced against the solenoid face, and wherein upon contact with the solenoid face the contact member rotatably aligns with the solenoid face to facilitate the magnetic attachment thereto.

28. A weaving device as claimed in claim 27, and further comprising a second resilient member mounted on the frame and which is disposed in force transmitting relation between the frame and the latch, and wherein the second resilient member coacts with the latch to bias the latch toward the latched position.

29. A weaving device as claimed in claim 28, and wherein the hook is reciprocally movable along the course of travel in a first direction, and an opposite second direction, and wherein the hook moves into force transmitting relation against the first resilient member as the hook moves in the first direction.

30. A weaving device as claimed in claim 29, and wherein the latch has a main body with opposite first and second ends, and wherein the first axis of rotation is disposed intermediate the first and second ends, and the second axis of rotation is adjacent the second end thereof, and wherein the latch includes a third resilient member which is borne by the main body and which coacts with the first resilient member.

31. A weaving device as claimed in claim 30, and wherein the first resilient member is positioned between the first axis of rotation and the first end of the main body, and comprises an elongated member which deflects along an arcuately shaped path of travel, and wherein the third resilient member limits the movement of the elongated member along the arcuately shaped path of travel.

32. A weaving device comprising:

a frame;

an eyelet movably mounted on the frame;

a hook mounted on the eyelet and reciprocally movable along a course of travel in a first direction and an opposite second direction;

a solenoid mounted on the frame, and which has a solenoid face, and wherein the solenoid produces a magnetic field when energized with electrical current;

a latch pivotally mounted on the frame, and which is rotatable with respect to the frame about a first axis between a latched position and an unlatched position, and wherein the first axis is substantially parallel to the solenoid face, and wherein the latch further includes a first resilient member; and a contact member rotatably mounted on the latch, and wherein the contact member is fabricated of a material which is magnetically attracted to the solenoid when energized, and wherein the contact member is rotatable with respect to the latch about a second axis, and wherein the second axis is substantially parallel to the first axis, and wherein the contact member has a contact surface formed thereon, and wherein the hook, upon movement in the first direction, engages the first resilient member, and wherein such movement of the hook against the first resilient member moves the latch to the unlatched position, and wherein such movement of the latch to the unlatched position simultaneously moves the contact surface against the solenoid face and causes the contact member to rotatably align with the solenoid, and wherein continued movement of the hook in the first direction and against the first biasing member, when the latch is in the unlatched position, causes a further deflection of the first biasing member which ensures substantially parallel alignment of the contact surface with the solenoid face, and facilitates magnetic attachment of the contact member to the solenoid when the solenoid is energized.

33. A weaving device as claimed in claim 32, and further comprising a second resilient member mounted in force transmitting relation between the frame and the latch, and which coacts with the latch to bias the latch toward the latched position.

34. A weaving device as claimed in claim 33, and wherein the hook is biased in the second direction.

35. A weaving device as claimed in claim 34, and wherein the hook has a first end and an opposite second end, and wherein the second end is connected to the eyelet.

36. A weaving device as claimed in claim 35, and wherein the latch has a first end and an opposite second end, and wherein the contact member is rotatably mounted on the second end of the latch.

37. A weaving device as claimed in claim 36, and wherein the solenoid is mounted on a support member, and wherein the support member is releasably mounted on the frame.

38. A weaving device as claimed in claim 37, and wherein the presence of the magnetic field, when the latch is in the unlatched position, causes the latch to be magnetically retained in the unlatched position.

39. A weaving device as claimed in claim 38, and wherein the first axis of rotation is located between the first and second ends of the latch.

40. A weaving device as claimed in claim 39, and wherein the second axis of rotation is located adjacent the second end of the latch.

41. A weaving device as claimed in claim 40, and wherein the second resilient member coacts with the latch at a location between the first axis of rotation and the second axis of rotation.

42. A weaving device as claimed in claim 41, and wherein the latch further comprises a third resilient member located between the first axis of rotation and the first end, and which further coacts with the first resilient member to limit motion of the first resilient member.

43. A weaving device as claimed in claim 42, and wherein the third resilient member comprises a releasable member mounted on the latch.

44. A weaving device as claimed in claim 43, and wherein the first and second axes of rotation are laterally offset, one from the other.

45. A weaving device comprising:

a frame;

an eyelet movably mounted on the frame;

a hook having a first end and an opposite second end, and wherein the second end is connected to the eyelet, and wherein the hook is reciprocally movable along a course of travel in a first direction and an opposite second direction;

a solenoid mounted on the frame, and which produces a magnetic field when energized with electrical current;

a latch pivotally mounted on the frame, and which has a main body with a first end, and an opposite second end, and wherein the latch is pivotable with respect to the frame about a first axis between a latched position and an unlatched position, and wherein the first end of the latch is matingly engageable with the hook, and wherein the latch is biased toward the latched position, and wherein the first end of the latch has a first resilient member made integral therewith, and wherein the first biasing member is located between the first end and the first axis; and a contact member rotatably mounted on the latch, and wherein the contact member is made of a material which is magnetically attracted to the solenoid when it is energized, and wherein the contact member is rotatable with respect to the latch about a second axis, and wherein the second axis is substantially parallel to, and offset from, the first axis, and wherein movement of the first end of the hook against the first resilient member as the hook moves in the first direction causes movement of the latch to the unlatched position, and wherein, in the unlatched position, the contact member is moved against the solenoid face which causes the contact member to rotatably align with the solenoid face, and wherein continued movement of the hook in the first direction and against the first resilient member causes the hook to deflect the first resilient member, and wherein such deflection causes the contact member to be forced against the solenoid face to ensure substantially complete contact of the contact member with the solenoid face to facilitate magnetic attachment of the contact member to the solenoid face when energized, and wherein the presence of the magnetic field when the latch is in the unlatched position causes the latch to be retained in the unlatched position such that the latch is prevented from engaging the hook as the hook moves in the second direction.

46. A weaving device as claimed in claim 45, and further comprising a second resilient member mounted in force transmitting relation between the frame and the latch, and coacting with the latch to normally bias the latch toward the latched position, and wherein the second resilient member is located between the first axis and the second end of the latch.

47. A weaving device as claimed in claim 46, and wherein the first end of the latch is shaped to matingly engage the hook when the latch moves to the latched position.

48. A weaving device as claimed in claim 46, and wherein the first axis is located between the first and second ends of the latch.

49. A weaving device as claimed in claim 48, and wherein the first resilient member is an elongated deflectable member.

50. A weaving device as claimed in claim 49, and wherein the latch is a substantially planar plate having a substantially constant thickness, and wherein the first and second axes are substantially normal to the plate, and offset one from the other.

51. A weaving device as claimed in claim 50, and wherein the first resilient member forms an elongated member which is oblique to the first and second directions of travel of the hook.

52. A weaving device as claimed in claim 50, and further comprising a third resilient member which is disposed in force transmitting relation relative to the first resilient member, and which is borne by the latch, and wherein the third resilient member resists the deflection of the first resilient member.

53. A weaving device as claimed in claim 51, and wherein the rotation of the contact member is restrained by the latch to a predetermined range of rotation.

54. A weaving device as claimed in claim 53, and wherein the weaving device further comprises a substantially cylindrically shaped shaft which is mounted on the frame, and wherein the shaft is substantially coaxially aligned relative to the first axis of rotation, and wherein the latch defines a substantially circular aperture which rotatably receives the shaft.

55. A weaving device as claimed in claim 54, and further comprising a guide member mounted on the frame, and which maintains the latch in substantial alignment with the hook and solenoid.

56. A weaving device as claimed in claim 55, and wherein the first resilient member has a path of travel between a first point of travel and a second point of travel, and wherein movement to the second point of travel causes force to be transmitted to the latch, and wherein the third resilient member resists deflection of the first resilient member beyond the second point of travel.

57. A weaving device as claimed in claim 56, and wherein the solenoid is mounted on a support member which is releasably mounted on the frame.

58. A weaving device, having a frame, an eyelet movably mounted on the frame, and a hook which is mounted on the eyelet and movable along a course of travel, the weaving device comprising:

a solenoid borne by the frame and operable to create a magnetic field when selectively energized;

a latch pivotally borne by the frame and operable to selectively engage the hook, and wherein the latch has an elongated main body with opposite first and second ends, and wherein the elongated main body is oriented along a line of reference which extends between the first and second ends, and wherein the main body is rotatable about a first axis which is located intermediate the first and second ends and which is laterally offset from the line of reference, and wherein the main body is rotatable between a latched and an unlatched position, and wherein the first end of the latch is shaped to matingly engage the hook when the main body is in the latched position, and wherein a first resilient member is borne by the main body and located between the first end and the first axis, and wherein the first resilient member is oriented in a position which is oblique to, and laterally offset from, the line of reference, and wherein the first resilient member urges the latch into the unlatched position when it is engaged by the hook; and a self-aligning contact member rotatably borne on the second end of the main body, the contact member being fabricated from a material so which is magnetically attracted to the solenoid when the solenoid is energized, and wherein the contact member rotates about a second axis which is oriented along the line of reference, and wherein the main body, when located in the unlatched position, causes the contact member to be moved into substantially immediate self-aligned contact with the solenoid, the solenoid retaining the latch in the unlatched position when energized.

59. A weaving device as claimed in claim 58, and wherein the solenoid is releasably borne by the frame to facilitate removal and replacement thereof.

60. A weaving device as claimed in claim 59, and wherein the first resilient member extends generally obliquely in the direction of the second end of the main body of the latch.

61. A weaving device as claimed in claim 60, and further comprising a second resilient member borne by the frame and disposed in force transmitting relation relative to the latch, and which further biases the latch toward the latched position.

62. A weaving device as claimed in claim 61, and wherein the second resilient member contacts the main body of the latch between the first and the second axes of rotation.

63. A weaving device as claimed in claim 62, and further comprising a third resilient member which resists deflection of the first resilient member.

64. A weaving device as claimed in claim 58 wherein the elongated main body includes a resilient leg section situated between the first axis and the second end.

* * * * *